US006179403B1

(12) United States Patent
Xie et al.

(10) Patent No.: US 6,179,403 B1
(45) Date of Patent: Jan. 30, 2001

(54) DOCUMENT DEPENDENT MAINTENANCE PROCEDURE FOR INK JET PRINTER

(75) Inventors: Yonglin Xie, Webster; Ivan Rezanka, Pittsford; Peter A. Torpey, Webster, all of NY (US)

(73) Assignee: Xerox Corporation, Stamford, CT (US)

( * ) Notice: Under 35 U.S.C. 154(b), the term of this patent shall be extended for 0 days.

(21) Appl. No.: 09/350,127

(22) Filed: Jul. 9, 1999

(51) Int. Cl.[7] ..... B41J 2/165
(52) U.S. Cl. ..... 347/23; 347/5
(58) Field of Search ..... 347/23, 5

(56) References Cited

U.S. PATENT DOCUMENTS

| | | | |
|---|---|---|---|
| 3,586,049 | 6/1971 | Adamson | 137/625.41 |
| 4,679,059 | 7/1987 | Dagna | 347/50 |
| 4,746,938 | 5/1988 | Yamamori et al. | 347/28 |
| 4,774,530 | 9/1988 | Hawkins | 347/63 |
| 4,849,774 | 7/1989 | Endo et al. | 347/56 |
| 4,853,717 | 8/1989 | Harmon et al. | 347/29 |
| 4,855,764 | 8/1989 | Humbs et al. | 347/31 |
| 4,908,638 | 3/1990 | Albosta et al. | 347/43 |
| 5,184,147 | 2/1993 | MacLane et al. | 347/30 |
| 5,192,959 | 3/1993 | Drake et al. | 347/42 |
| 5,198,054 | 3/1993 | Drake et al. | 156/64 |
| 5,206,666 | 4/1993 | Watanabe et al. | 347/3 |
| 5,257,044 | 10/1993 | Carlotta et al. | 347/32 |
| 5,367,326 | 11/1994 | Pond et al. | 347/22 |
| 5,534,897 | 7/1996 | Anderson et al. | 347/32 |
| 5,565,898 * | 10/1996 | Sakuma | 347/23 |
| 5,640,182 | 6/1997 | Bahrami et al. | 347/33 |
| 5,731,823 * | 3/1998 | Miller et al. | 347/5 |
| 5,787,195 * | 7/1998 | Tsujimoto et al. | 382/176 |
| 5,790,146 | 8/1998 | Anderson | 347/28 |
| 5,819,798 | 10/1998 | Claflin et al. | 137/625.11 |

* cited by examiner

*Primary Examiner*—N. Le
*Assistant Examiner*—Shih-Wen Hsieh
(74) *Attorney, Agent, or Firm*—Oliff & Berridge, PLC

(57) ABSTRACT

A method for controlling a maintenance unit in a printer includes determining an image type of an image to be printed, the image type being selected from at least a first image type and a second image type different from the first image type, setting a maintenance interval for the maintenance unit in accordance with the image type, wherein a maintenance interval for the first image type is different from a maintenance interval for the second image type. A printer embodying such a method, and in particular a printer for printing an image an a substrate, includes a printhead, a maintenance unit for performing periodic maintenance on the printhead, and a controller for controlling said maintenance unit according to the described method.

18 Claims, 3 Drawing Sheets

DOCUMENT DEPENDENT MAINTENANCE PROCEDURE FOR INK JET PRINTER

BACKGROUND OF THE INVENTION

1. Field of Invention

This invention relates to a document dependent maintenance procedure for ink jet printers, and more particularly to a maintenance procedure utilized in ink jet printers to maintain proper operation of the printhead. In embodiments, the present invention relates to maintenance procedures where printhead maintenance intervals are determined based upon the type of documents being printed. The present invention also relates to control structures for implementing such maintenance procedures, and printers incorporating such maintenance procedures and control structures.

2. Description of Related Art

Liquid ink printers of the type frequently referred to as continuous stream or as drop-on-demand, such as piezoelectric, acoustic, phase change wax-based or thermal, have at least one printhead from which droplets of ink are directed towards a recording sheet. Within the printhead, the ink is contained in a plurality of channels. Power pulses cause the droplets of ink to be expelled as required from orifices or nozzles at the end of the channels.

In a thermal ink-jet printer, the power pulses are usually produced by resistors, each located in a respective one of the channels, which are individually addressable to heat and vaporize ink in the channels. As voltage is applied across a selected resistor, a vapor bubble grows in the associated channel and initially bulges from the channel orifice followed by collapse of the bubble. The ink within the channel then retracts and separates from the bulging ink thereby forming a droplet moving in a direction away from the channel orifice and towards the recording medium whereupon hitting the recording medium a dot or spot of ink is deposited. The channel is then refilled by capillary action, which, in turn, draws ink from a supply container of liquid ink. Operation of a thermal ink-jet printer is described in, for example, U.S. Pat. No. 4,849,774.

The ink jet printhead may be incorporated into either a carriage type printer, a partial width array type printer, or a page-width type printer. The carriage type printer typically has a relatively small printhead containing the ink channels and nozzles. The printhead can be sealingly attached to a disposable ink supply cartridge and the combined printhead and cartridge assembly is attached to a carriage, which is reciprocated to print one swath of information (equal to the length of a column of nozzles), at a time, on a stationary recording medium, such as paper or a transparency. After the swath is printed, the paper is stepped a distance equal to the height of the printed swath or a portion thereof, so that the next printed swath is contiguous or overlapping therewith. This procedure is repeated until the entire page is printed. In contrast, the page width printer includes a stationary printhead having a length sufficient to print across the width or length of a sheet of recording medium at a time. The recording medium is continually moved past the page width printhead in a direction substantially normal to the printhead length and at a constant or varying speed during the printing process. A page width ink-jet printer is described, for instance, in U.S. Pat. No. 5,192,959.

It has been recognized that there is a need to maintain the ink ejecting nozzles of an ink jet printhead, for example, by periodically cleaning the orifices when the printhead is in use, and/or by capping the printhead when the printer is out of use or is idle for extended periods of time. The capping of the printhead is intended to prevent the ink in the printhead from drying out. There is also a need to prime a printhead before use, to insure that the printhead channels are completely filled with ink and contain no contaminants or air bubbles and also periodically to maintain proper functioning of the orifices. Maintenance and/or priming stations for the printheads of various types of ink jet printers are described in, for example, U.S. Pat. Nos. 4,855,764, 4,853,717, and 4,746,938. Removal of gas from the ink reservoir of a printhead during printing is described in U.S. Pat. No. 4,679,059.

It has been found that to properly maintain an ink jet printhead, two separate operations must be performed. In a first operation, a maintenance assembly is typically used to maintain proper condition or operation of the printhead nozzles by priming the nozzles, by wiping clean the nozzle face of the printhead, and/or by vacuuming the face of the printhead to remove any contaminants or ink that may have collected thereon. The second operation is to cap the printhead if the printhead nozzles will be exposed to air for extended periods of time to thereby prevent the ink contained in the nozzles from drying out. To prevent drying, a cap is brought into contact with a printhead to form a substantially airtight seal with the face of the printhead and around the nozzles.

Various methods and apparatus for maintaining the condition of ink jet printheads are generally known in the art, as illustrated and described in the following references.

U.S. Pat. No. 4,908,638 to Albosta et al., describes an n-way selecting mechanism for selecting inks from a number of ink supply containers for delivery to the marking head (printhead) of an ink jet printer. The selecting mechanism includes a rotary diverting valve, which is positioned to allow the marking head to receive ink from one color supply container or another supply container.

U.S. Pat. No. 3,586,049 to Adamson describes an oscillatory valve for selectively connecting three inlets to an outlet.

U.S. Pat. No. 5,206,666 to Watanabe et al., describes an ink jet recording apparatus having a full-line type recording head rotatably supported between a recording position and a non-recording position. A cleaning member contacts the recording head during rotation of the recording head to remove deposited ink or foreign matter. In the non-recording position, the printhead is capped.

U.S. Pat. No. 5,257,044 to Carlotta et al., describes a cap actuation mechanism for use in a maintenance station for an ink jet printhead in a scanning type ink jet printer. A cap located on a cap carriage in an ink jet printer maintenance station provides the functions of printhead nozzle capping, priming, cleaning, and refreshing, as well as waste ink management.

U.S. Pat. No. 5,367,326 to Pond et al., describes a pagewidth ink jet printer having a movable cleaning/priming station adapted for movement parallel to and along an array of printhead nozzles. The cleaning and priming station is slidingly moved along a ledge surface so that the cleaning and priming station is maintained a fixed distance from the face of the printhead.

As apparent from the above references, a printhead maintenance assembly generally comprises multiple components, used for maintaining and/or capping the printhead. For example, a typical maintenance assembly may include: (1) a cap assembly that can be moved to seal around the exterior of the printhead nozzle surface while staying as far away from the nozzles as possible so as to provide an environment in which drying air is excluded while the nozzles are capped; (2) a wiper that can be raised to engage the nozzle surface of the printhead and clear away ink, debris and undesirable matter collected on the surface of the nozzle plate area, and lowered when wiping is not desired; (3) a "spit cup" for receiving ink ejected from the nozzles to remove contaminated ink from the nozzles and maintain less used nozzles in proper working order; (4) a selectively energizable drive assembly including a gear train for moving the cap, wiper and spit cup; and (5) an absorption pad for maintaining liquid ink so that the printer may be transported without damaging or soiling parts of the printer with purged ink.

However, the maintenance assemblies are complicated by the increasing use of colored inks (i.e., multiple colors other than or in addition to black ink) in the ink jet printers. For example, water resistant monochrome ink typically requires little spitting maintenance but requires a significant wiping force to be exerted to wipe the fast drying ink from the nozzle plate area. On the other hand, a tri-color printhead with its smaller nozzles and slower drying ink requires many more spits and wipes, but because the wiping is more frequent and the ink is slower drying, a lighter wiping force can be used and is preferred. Also, a tri-color printhead poses the problem of wiping the ink and debris from the nozzle surface without transferring ink of one color to the area of the nozzles that eject ink of another color. Thus, in order for a single printhead maintenance system to operate satisfactorily during color and monochrome printing, it must be capable of responding to the different needs of the printhead geometry presented to it. Furthermore, the maintenance assemblies are more complicated based on whether the printer is used to print one color ink or multiple color inks, and whether the multiple color inks are contained in a single printhead or in multiple printheads. For example, in existing printhead maintenance mechanisms used in ink-jet printers, either each color of the printhead can have a separate maintenance assembly or, if all of the colors are housed in one printhead and the monochrome (usually black) is housed in another printhead, the two separate printheads may each have a separate maintenance assembly. This is generally true regardless of whether the color printhead and the black printhead reside in the printer at the same time or if the two printheads are interchangeably mounted on a single printhead carrier.

A problem with the various known ink jet printhead maintenance systems and procedures, however, is that the maintenance procedures by their nature decrease printer throughput. That is, because time must be taken to perform the maintenance procedure, printing must be halted, or the start of printing must be delayed, so as to allow the maintenance procedure time to complete its functions. Furthermore, printer productivity is decreased due to the expenditure of ink in the operation. For example, when the maintenance procedure requires ejecting ink from the printhead into a catch basin, that ink can not be used for subsequent printing, and is lost. As the number or frequency of maintenance periods increases, the amount of printing that can be performed with a given volume of ink accordingly decreases.

SUMMARY OF THE INVENTION

Accordingly, a need exists in the ink jet art, and in the printing arts in general, for improved maintenance procedures that permit increased efficiency and productivity of the printing process, without sacrificing image quality.

However, because the standard maintenance procedures use set time intervals for performing the maintenance functions, any changes in terms of frequency generally resulted in reduction of efficiency or reduction of print quality. For example, if more frequent maintenance periods were used, the result is decreased throughput; if less frequent maintenance periods were used, the result is decreased print quality.

The present invention overcomes these deficiencies of the prior art, by providing a more efficient and higher productivity maintenance procedure for use in ink jet, or other, printing processes. The present invention accomplishes these goals by implementing the maintenance procedure using maintenance intervals that are dependent upon the type of image being printed. Thus, for example, in image printing where decreases in print quality are less evident, longer maintenance intervals are used, but in image printing where decreases in print quality are more evident, shorter maintenance intervals are used.

Thus, in embodiments of this invention, the present invention provides a method for controlling a maintenance unit in a printer, comprising:

determining an image type of an image to be printed, said image type being selected from at least a first image type and a second image type different from said first image type, setting a maintenance interval for said maintenance unit in accordance with said image type, wherein a maintenance interval for said first image type is different from a maintenance interval for said second image type.

In embodiments, the present invention also provides a printer for printing an image on a substrate, comprising:

a printhead, a maintenance unit for performing periodic maintenance on said printhead, and a controller for controlling said maintenance unit according to the method of claim 1.

BRIEF DESCRIPTION OF THE DRAWINGS

These and other advantages and features of this invention will be apparent from the following, especially when considered with the accompanying drawings, in which.

DETAILED DESCRIPTION OF PREFERRED EMBODIMENTS

Figure 1:
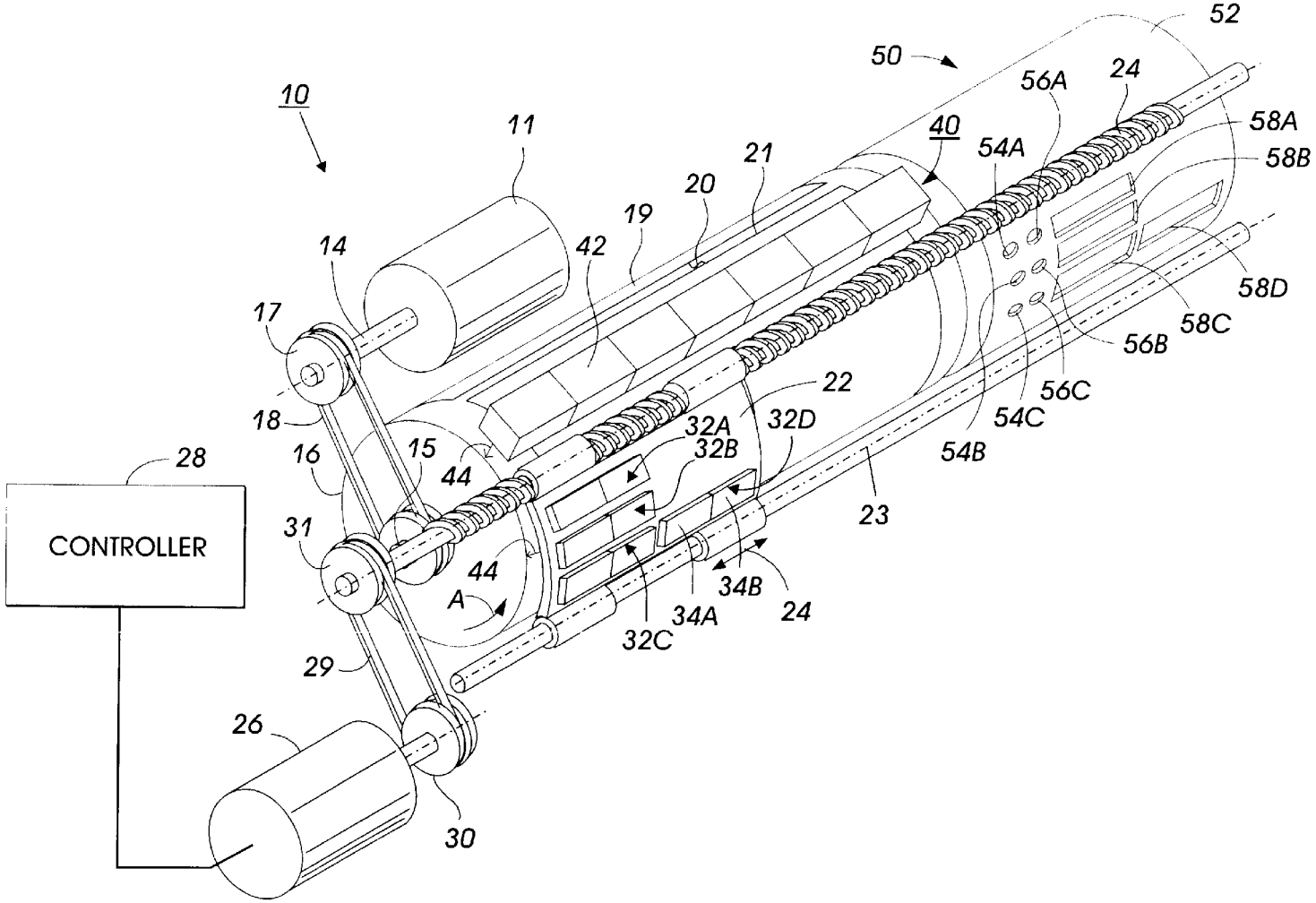
FIG. 1 illustrates a partial perspective view of a liquid ink printer having a plurality of partial width array printheads and a pagewidth printbar for ink jet printing.

FIG. 1 illustrates the essential components of a printing apparatus, generally designated 10, in which the outside covers or case and associated supporting components of the printing apparatus are omitted for clarity. The printing apparatus 10 includes a motor 11 connected to a suitable power supply (not shown) and arranged with an output shaft 14 parallel to an axis 15 of a cylindrical drum 16, which is supported for rotation on bearings (not shown). A pulley 17 permits direct engagement of the output shaft 14, to a drive belt 18 for enabling the drum 16 to be continuously rotationally driven by the motor 11 in the direction of an arrow A at a predetermined rotational speed.

A recording medium 19, such as a sheet of paper or a transparency, is placed over an outer surface 20 of the drum 16, with a leading edge 21 attached to the surface 20 before printing to enable attachment of the sheet thereto either through the application of a vacuum through holes in the drum 16 (not shown) or through other means of holding, such as electrostatic. As the drum 16 rotates, the sheet of paper 19 is moved past a printhead carriage 22 supported by a lead screw 24 arranged with the axis thereof parallel to the axis 15 of the drum 16 and supported by fixed bearings (not shown), which enable the carriage 22 to slidably translate axially. A carriage rail 23 provides further support for the carriage as the carriage moves in the direction of arrow 24 perpendicular to the moving direction of the sheet 21. A second motor 26, such as a stepper motor or other positioning mechanism, controlled by a controller 28, drives the lead screw with a second belt 29 connecting a clutch 30 and a clutch 31 attached to the lead screw 24 for movement thereof.

The printhead carriage 22 advances a first partial width array printbar 32A, a second partial width array printbar 32B, a third partial width array printbar 32C, and a fourth partial width array printbar 32D in the direction of arrow 24 for printing on the sheet 21. The first, second and third partial width array printbars 32A–C, respectively, each print one of the colors cyan, magenta or yellow for color printing. The fourth partial width array printbar 32D prints black when necessary, especially when printing graphics.

Each individual printbar 32A–32D includes a first printhead die 34A and a second printhead die 34B butted together and mounted on a substrate (not shown), which can be made of a material such as graphite or metal. Each of the printhead dies 34A and 34B include several hundred or more nozzles, which are fired sequentially in banks of nozzles. All of the printhead die are fired in parallel for one full printing of all the partial width arrays 32 on the carriage 22.

In addition to the partial width arrays 32, the printer 10 includes a full-width array or pagewidth printbar 40 supported by an appropriate support structure (not shown) above the drum 16 for printing on the recording medium 21. The pagewidth printbar 40 has a length sufficient to print across the entire width (or length) of the recording medium during a single pass of the recording medium beneath the printbar. The printbar 40 includes a plurality of printhead subunits 42 affixed to a supporting substrate (not shown) in an abutted fashion, such as taught by U.S. Pat. No. 5,198,054 to Drake at al., the entire disclosure of which is incorporated herein by reference. Alternatively, individual subunits 42 may be spaced from one another by a distance approximately equal to the length of a single subunit and bonded to opposing surfaces of the supporting substrate. In one embodiment, subunits 42 may be similar in construction to that described in U.S. Pat. No. 4,774,530 to Hawkins, the entire disclosure of which is incorporated herein by reference.

Although the above discussion of the printer with respect to FIG. 1 has been made based on the use of partial width printheads 32A–D and full width printbar 40, the present invention is in no way limited to such embodiments. As will be readily apparent to those of ordinary skill in the art, the maintenance procedures of the present invention, which are discussed in detail below, can be applied in any printer that utilizes a maintenance procedure to maintain proper operation of a printhead. Suitable printheads can include any of the various geometries used in the art, from printheads having only a single nozzle, to printheads having sufficient nozzles to print a full width and/or length of a page. The present invention thus encompasses the use of the present maintenance procedure in conjunction with any of a small printhead, a partial width printhead or a full-width printbar.

Again with reference to FIG. 1, the forward facing edges of the subunits 34 and the subunits 42 contain ink jet printheads having droplet ejecting orifices or nozzles (not shown), which eject ink along a trajectory 44 substantially perpendicular to the surface of the recording medium 21. Printed wiring boards (not shown) contain circuitry required to interface and cause the individual heating elements (not shown) in the subunits to eject ink droplets from the nozzles. While not shown in FIG. 1, the printed wiring boards are connected to individual contacts contained on the subunits via a commonly known wire bonding technique. The data required to drive the individual heating elements of the printhead subunits is supplied from an external system by a standard printer interface, modified and/or buffered by a printer micro processor (not shown) within the printer and transferred to the printheads by ribbon or other cables (not shown) attached thereto.

The printing apparatus 10 also includes a maintenance system 50 located at one end of the drum 16. The maintenance system 50 includes assemblies that provide wet wiping of the nozzles of the printheads 32 and 34 as well as vacuuming of the same printheads for maintenance thereof. Although not limited thereto, suitable wet wipe nozzles and vacuum nozzles are disclosed in U.S. Pat. No. 5,790,146, the entire disclosure of which is incorporated herein by reference. The wet wipe nozzles are located within a stationary drum housing 52 and extend through a plurality of apertures 54A, 54B and 54C when necessary to provide maintenance functions. When the printhead carriage moves to the maintenance position, the wet wipers apply a fluid to the ink jet nozzles such that any dried ink, viscous plugs or other debris is loosened on the front face of the ink jet printbars. Once the debris has been sufficiently loosened, a plurality of vacuum nozzles each extending through a plurality of vacuum nozzle apertures 56A–56C vacuum away any of the cleaning fluid as well as debris loosened thereby.

Once a printing operation has been completed and any cleaning of the printbars has been completed, if necessary, the carriage 22 is moved into position above a plurality of apertures 58A–58D. A plurality of capping members disposed within the housing 50, are moved into contact with the front faces of the printbars 32 and 34 through the apertures 58 to thereby cap the printbars to substantially prevent any ink that has been collected in the nozzles of the printbars from drying out. The cap members are also used in a priming operation to be described later with reference to FIG. 2.

Figure 2:
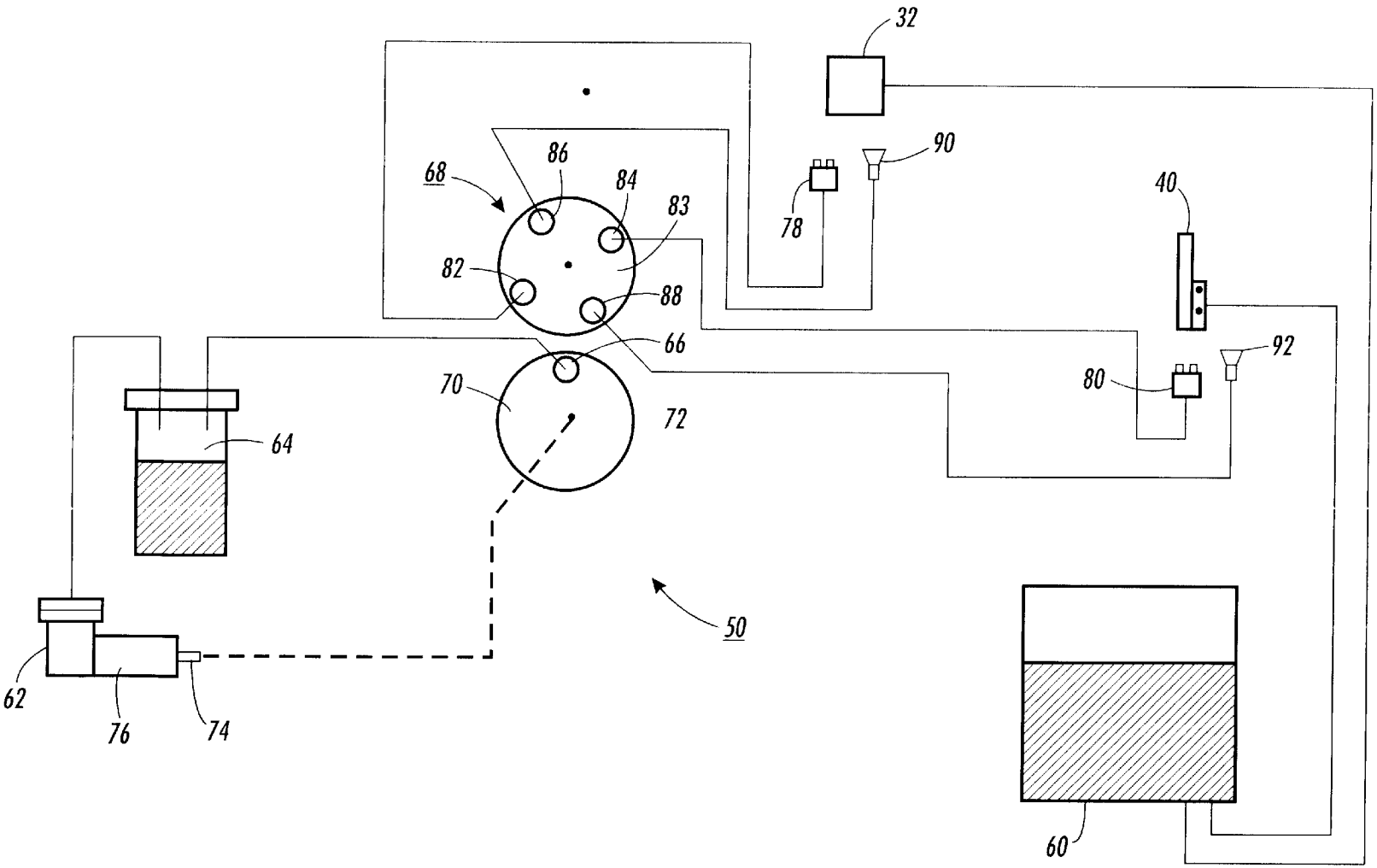
FIG. 2 illustrates a fluid/air schematic diagram of an ink reservoir, a vacuum source, and a multiport rotary indexing valve and connections thereof for a maintenance system of the liquid ink printer.

FIG. 2 illustrates a fluid/air schematic diagram of the maintenance system 50 showing the vacuum supply lines coupled to vacuum nozzles for both the full width array printbar 40 as well as for one of the partial width array printbars 32 and an ink reservoir 60 for supplying ink to not only the full width array printbar 40 but also to each of the partial width array printbars. A vacuum pump 62, such as a diaphragm pump or other vacuum generating device, generates a vacuum through a waste sump that is connected to an inlet 66 of a two piece multi-position rotary valve 68, which is used to select and apply either a vacuum for cleaning the faces of the printheads or for applying a vacuum used to prime the printheads during a priming operation, which is typically necessary before the start of printing or oftentimes when the printheads lose prime. A selecting member 70 of the rotary valve includes the aperture 66 and rotates about an axis 72. A shaft 74 extends through the stepper motor and is coupled to the vacuum pump 62, such that the stepper motor 76 drives not only the vacuum pump but also the rotary valve.

To begin printing, each of the printheads are primed by drawing ink from the ink reservoir 60 through the printheads and into a capping member 78 associated with each of the partial width printhead arrays 32 and through a capping member 80 used to prime as well as to cap the full width array printbar 40. During a priming operation for the partial width array 32, the aperture 66 of the rotary valve 68 is moved by the stepper motor 76 into alignment with an aperture 82 of a stator or multiple port member 83. When the aperture 66 is aligned with the aperture 82 of the rotary valve 90, a vacuum is applied for priming the partial width array printhead. An aperture 84 of the rotary valve 68 provides for priming of the full width array 40.

After printing has been completed, or at other times when a maintenance operation is necessary, the aperture 66 is aligned with either an aperture 86, which is used to apply a vacuum to the front face of the printhead nozzles of printhead 32 or is used to apply a vacuum through an aperture 88 to the full width array printhead. Through the use of the multi-positioned rotary valve, the vacuum supplied by the vacuum pump 62 is used not only to provide for initial filling of the ink manifolds of each of the printbars, but is also used to vacuum the nozzles during a maintenance operation through vacuum nozzles 90 and 92. In this operation, the capping members 78 and 80 would be moved out of the capping position and vacuum nozzles 90 and 92 would be moved into position, all by the stepper motor 76.

Further detail with respect to the multi-positioned rotary valve is contained in U.S. Pat. No. 5,819,798, the entire disclosure of which is incorporated herein by reference. Further, although the printing and maintenance operations have been described with reference to this multi-positioned rotary valve, this is illustrative only of a single embodiment of the present invention. The maintenance procedures that are discussed in further detail below can be applied independent of the particular maintenance station and component parts.

Maintenance operations are periodically required in ink jet printers, and other applications, for various reasons. In particular, ink jet printheads have a number of potential failure modes that reduce print quality, and must therefore be corrected in a maintenance operation. First, during normal operation, a paper fiber or other particle may land on an ink jet print head nozzle surface in a way that interferes with printing. This is a random problem inherent to ink jet printing and in particular when paper is used as the print media. Also, the ink jet printhead nozzle orifice surface may become wetted with ink and cause nonuniform drop ejection and the mixing of ink colors, especially where nozzle orifices are closely spaced and wherein adjacent nozzle orifices eject drops of a different color. According to one approach to control wetting, the ink jet nozzle orifice surface may be coated with a thin layer of Teflon™ or other coating material as an anti-wetting agent. When the coating is in good condition, ink on the nozzle orifice surface beads up and away from the orifices and the ink meniscus at each orifice remains confined by the orifice geometry. The confined meniscus results in predictable and consistent drop formation and ejection velocity. However, under normal printing conditions, the anti-wetting properties of coatings may degrade. With this degradation, ink forms an irregular film emanating from the orifices. The menisci are then defined by the irregular boundary of the film, rather than the predictable and uniform boundaries of the orifices. Under these conditions, drop formation and ejection may no longer be uniform and copy quality is reduced. In addition, a film adjacent to orifices is an effective pathway for mixing ink of different colors from adjacent orifices. This mixed ink would show up as incorrectly colored pixels in resulting prints.

Wiping of the orifice surface with a wiper blade is effective at removing particles that interfere with printing. Also, it has been discovered that periodic wiping of the orifice surface is effective at preserving anti-wetting properties of coatings, such as Teflon™ coatings, thereby resulting in more uniform drop ejection and the preventing of color mixing. More specifically, rubbing areas of a nozzle orifice surface with a suitable wipe material, such as a resilient material, has been observed to increase ink contact angle in areas that are rubbed. Areas of a nozzle orifice surface that have not been wiped in this manner can more readily become contaminated with organic compounds. Apparently, the mechanical action of the wipe prevents the accumulation of contaminants, raise the surface energy of the coating and allow the ink to wet the nozzle orifice surface.

According to traditional maintenance procedures, maintenance operations in ink jet printers, as well as in other applications, are typically performed according to a set method based on the amount of printing that has been performed. For example, as disclosed in U.S. Pat. No. 5,184,147, maintenance operations would be performed automatically every n prints, or manually when indicated by a user. Thus, in the art, it has been traditional to employ maintenance intervals that are set based on the type of ink being used and the type of ejector incorporated into the printer. Once set, these maintenance intervals remained constant regardless of the type of image being printed, the type of paper being used, or the color or number of inks being ejected.

In contrast, the present invention is directed to a maintenance control system and maintenance operation whereby the maintenance operations are performed at varying intervals, depending upon the specific print conditions. In particular, rather than utilizing a set maintenance interval, as has been the practice in the art, the present invention utilizes a varying maintenance interval, dependent upon various print factors. According to the present invention, the maintenance interval is selected to be longer where the printed image is less sensitive to latency defects, and the maintenance interval is selected to be shorter where the printed image is more sensitive to latency defects.

Latency defects, such as leading edge defects, in ink jet and other printing processes are well known to those of ordinary skill in the art. In short, leading edge latency defects arise due primarily to the evaporation of water and other volatile components of the ink near the printhead nozzles. As a result, the characteristics of the first few drops ejected from the nozzles are inferior as compared to the characteristics of steady state drops ejected from the same nozzles. Usually, the first few drops of ink ejected from nozzles that have not been fired for a longer period of time are smaller, slower, and more badly misdirected to the print medium. As a result, visible leading edge defects occur on the print medium.

However, the present inventors have discovered that the leading edge latency defects are more pronounced in some types of printing operations, and are less pronounced in others. They have thus discovered that by varying the maintenance interval based on the occurrence of the leading edge defect phenomenon, improved throughput and productivity as well as increased quality in the printing process can be realized.

According to the present invention, the timing of the maintenance intervals is selected based on the consideration of the characteristics of the image being printed. In particular, the timing of the maintenance intervals is selected based on the type of image being printed, i.e., graphic images, line drawing, and text images. In particular, according to embodiments of the present invention, a maintenance interval is set to a shorter time period in the case of graphic images, and particularly shaded images, where leading edge defects are the most apparent. A relatively longer maintenance interval is selected for line drawings. The longest maintenance interval is selected for text printing, where leading edge defects are the least apparent.

However, the present invention is not limited to such embodiments based on determination of image type as being graphic images, line drawing, and text images. Rather, the present invention can be used where the image type determination is based on the susceptibility of the particular image type to leading edge defect problems. For example, the present invention is equally applicable to object-oriented printing, where the maintenance interval can be selected based on the particular object being printed, such as text or pictorial. Likewise, the present invention is also applicable to draft/final mode printing, where the maintenance interval can be selected based on the particular print speed being selected. Thus, as used herein, the term "image" is intended to cover any of the various image characteristics, to include image type, image (object) content, and printing mode.

According to the present invention, the selection of the maintenance interval can be selected either manually by the end-user, or electronically by a suitable controller means. In embodiments where the selection is made manually, such selection can be made, for example, either by mechanical/electrical means, such as by a switch or selection device on the printer itself, or by electrical/software means, such as by sending a suitable control code to the printer controller from another control program. A drawback of such manual selection of the maintenance interval, however, is that such selection may not in fact match the image being printed, such as if the selection is not changed between various printing operations. An advantage, however, is that manual selection in effect provides an "override" function, whereby the user can select a shorter maintenance interval, i.e., select improved image quality, than would otherwise be provided.

Alternatively, selection of the maintenance interval can be selected automatically by the printer or its appropriate controller software or hardware. For example, the maintenance interval can be automatically selected based on the type of image information being sent to the printer controller, i.e., whether the image information is text or graphics. In another embodiment, the maintenance interval can be automatically selected by pre-processing the image, to determine the exact image content.

This latter embodiment, where a pre-processing algorithm is used, is particularly preferred in embodiments of the present invention. In particular, this embodiment provides more precise control of the maintenance interval. For example, the pre-processing procedure, which is well-known for other uses such as marking material coverage reduction, can be readily conducted according to known processes. This procedure, however, provides more precise control because it can differentiate between various shaded images and various line art images. For example, in the case of shaded images, a shorter maintenance interval can be selected for 1/16-tone images, a slightly longer maintenance interval can be selected for 1/4-tone images, and a longer maintenance interval can be selected for halftone images. Similarly, in the case of line art drawings, a short maintenance interval can be selected for thin lines, and a longer maintenance interval can be selected for thick lines.

Based on the instant disclosure, various implementations of the present invention will be readily apparent to one of ordinary skill in the art. That is, various means for providing manual control, such as switches, toggles, menu-driven selections, and the like, are well known in the art and have been used for numerous other aspects of printer control. Likewise, various means for providing automatic control, such as pre-processing algorithms, and control code selection, are also well known in the art and have been used for numerous other aspects of printer control. Any of these various methods can be implemented for selecting suitable maintenance interval timing according to the present invention.

Furthermore, in either manual or automatic control, it is possible in accordance with the present invention to select the maintenance interval at virtually any stage of the printing process. With particular reference to the manual control, it will be apparent that the maintenance interval can be changed and/or selected at any time before, during or after a printing operation is completed. Similarly, in automatic control modes, the maintenance interval can also be selected and/or changed, or re-selected and/or changed, at any time.

For example, in embodiments of the present invention, the maintenance interval can be selected and/or changed between successive printed documents (or print jobs), between successive pages of a single printed document (or print job), or even between successive portions of an individual page of a document or print job. This latter embodiment is particularly applicable to object-printed printing, allowing the maintenance interval to be selected and/or changed as the particular object to be printed changes. This embodiment thereby provides even further advantages in terms of quality and throughput by permitting maintenance interval changes even within a single page.

Alternatively, where a printed document (or print job), or multiple pages within a printed document (or print job), contain several image (or object) types, it is possible in embodiments of the present invention to select a maintenance interval that would be applicable to that entire printed document (or print job) or page. In this embodiment, the maintenance interval could be based on, for example, the initial image type detected. More preferably, however, the maintenance interval is selected taking into account all of the various image types present in the printed document (or print job) or page. Thus, for example, the maintenance interval could be based on, for example, the image type having the highest susceptibility to leading edge defects (such as to provide the highest image quality), or the image type having the lowest susceptibility to leading edge defects (such as to provide the highest print throughput). Further, the maintenance interval could be based on, for example, the most predominant image type present in the respective printed document (or print job) or page. Image pre-processing methods are particularly suitable for implementing these embodiments of the present invention.

Although the above discussion has been made with respect to relative maintenance interval timing, it will be apparent that a base or default maintenance interval will be selected according to standard practices currently used in the art. That is, a baseline maintenance interval will be set based on the type of ink and type of ejector being used, according to the common practices used in the art. This baseline value will then serve as a point from which the longer or shorter maintenance intervals can be set. Alternatively, of course, various preset maintenance intervals can be set in the printer, to serve as the varying timer intervals or the various maintenance intervals cab be set entirely by the controller based, for example, on an image pre-processing algorithm.

Figure 3:
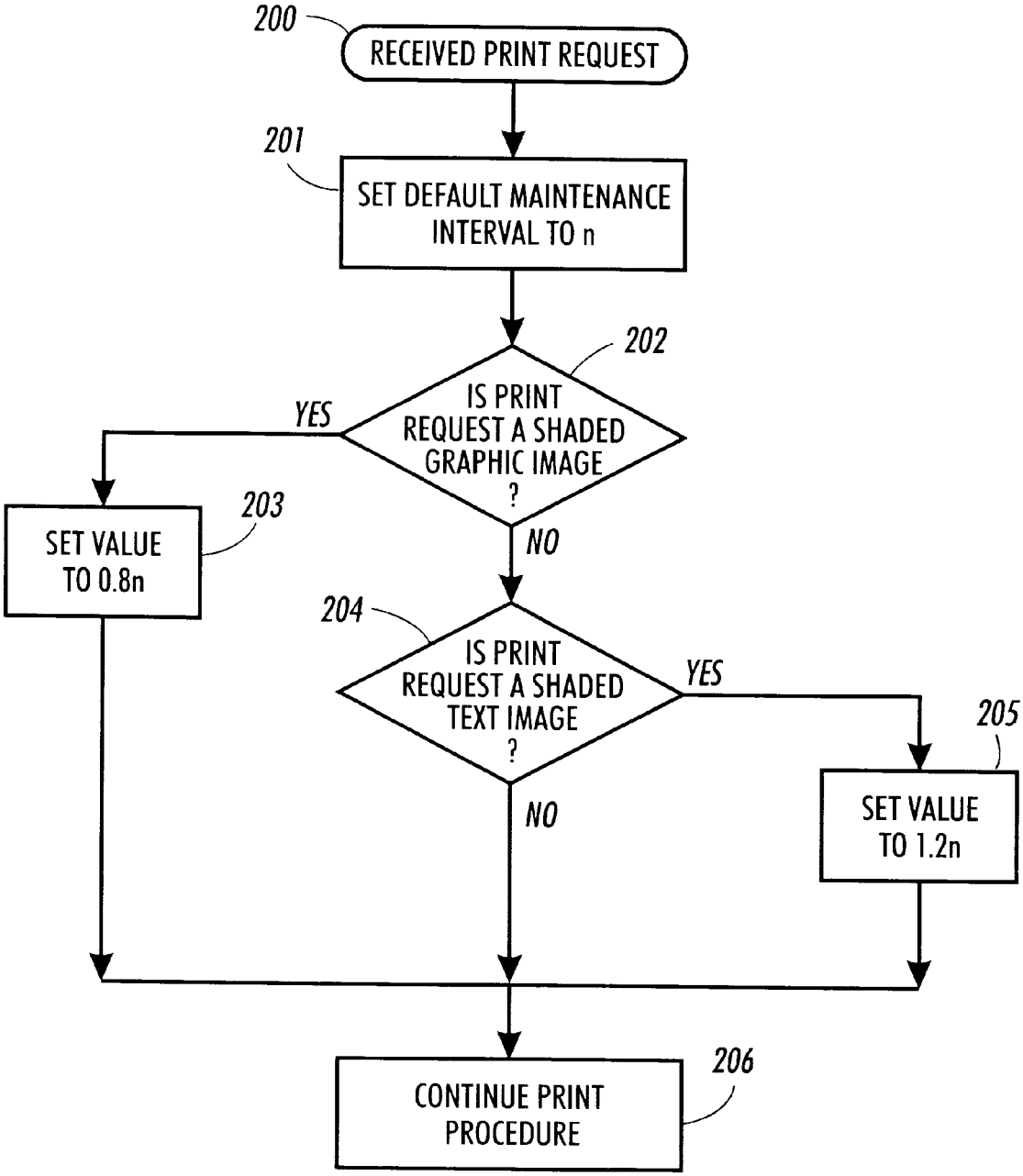
FIG. 3 is a simplified flowchart illustrating how the maintenance interval can be controlled to one of three different values.

The above-described maintenance procedures will now be described with reference to FIG. 3. FIG. 3 is a simplified flowchart illustrating how the maintenance interval can be controlled to one of three different values based on the image to be printed. In FIG. 3, at step 200, a print request is received by the printer controller. At step 201, the maintenance interval is set to a default value n. At step 202, the content of the image to be printed is used to determine if the value n should be changed. In particular, if the image is a shaded graphic image, control is passed to step 203, where the value n is set to 0.8n, i.e., a shorter maintenance interval is selected. At step 202, if the image is not a shaded graphic image, control is passed to step 204. Step 204 again considers the content of the image to be printed. In particular in step 204, if the image is a text image, control is passed to step 205, where the value n is set to 1.2n, i.e., a longer maintenance interval is selected. At step 204, if the image is not a text graphic image, control is passed to step 206, i.e., no change is made to the maintenance interval value n. Thus, after each of respective steps 203, 204 or 205, the print operation is resumed at step 206. In this description of FIG. 3, the values 0.8n and 1.2n are purely arbitrary. Suitable values and relationships between the values could be determined by one of ordinary skill in the art based only on routine experimentation, and would depend on such factors as the specific printer being used, the type of printing operation (e.g., ink jet, hot melt ink, etc.) used in the printer, and the specific inks being used.

In embodiments of the present invention, the printer must accommodate at least two different maintenance interval settings, i.e., a long interval and a short interval. In other embodiments of the present invention, it is preferred that the printer accommodate at least three, preferably four, more preferably five or even more, maintenance interval settings. For example, where three maintenance intervals are permitted, one can be set for graphic images, one can be set for line art images, and a third can be set for text images. As a further example, where five maintenance intervals are permitted, one can be set for low area coverage shaded graphic images, one can be set for high area coverage shaded graphic images, one can be set for thin line art images, one can be set for thick line art images, and one can be set for text images. In embodiments where pre-processing of the image is conducted, the number of different maintenance intervals can be almost unlimited. However, in the interest of throughput and efficiency, it may be preferred in embodiments to set threshold lower and upper limits for the maintenance interval, to prevent too many or too few maintenance operations from being selected.

Alternatively, in embodiments, the image types can be related based more on quality of the image rather than on the content of the image. For example, it is well known in the art to incorporate different print modes into a printer, such as a draft or fast (i.e., high-speed/low quality) print mode, normal (or intermediate) print mode, and a final (or low-speed/high quality) print mode. When so configured, the draft or fast print mode generally operates at a much higher speed, because it is designed for high print throughput at a lower print quality, whereas the normal and final print modes generally operate at slower speeds, because they are designed for high print quality at consequent lower throughput. Such speed/quality variations can be selected, for example, by altering the carriage speed and the number of passes to print an image. Thus, for example, a draft or high-speed print mode can be selected to correspond to a single-pass at high carriage speed of, for example, 30 inches per second (ips), whereas a high quality/low speed print mode can be selected to correspond to a multi-pass at low carriage speed of, for example, 10 ips. Intermediate print modes can also be selected to correspond, for example, to two-pass at 20 ips.

In these embodiments also, the maintenance control of the present invention can be utilized. Thus, for example, a longer maintenance interval can be utilized for a higher speed print mode, thereby further increasing the throughput. In contrast, a shorter maintenance interval can be utilized for a higher quality print mode, thereby further increasing the quality of the resultant image. As described above, such selection of the print mode (and resultant corresponding maintenance interval) can be performed manually by a user, or by a suitable printer control software or hardware.

Although the present invention has been described above with reference to a single "maintenance operation" or "maintenance procedure," it will be readily apparent to those of ordinary skill in the art that the present invention can be directly applied where multiple maintenance operations or procedures are used. For example, as described above, general maintenance procedures in ink jet and similar printers involve the separate operations of wiping, spitting, vacuuming, and capping. As is generally known, not all of this separate operations are performed at the same time, and they are often performed at varying intervals. According to the present invention, it is possible to adjust the maintenance interval of any or all of these separate functions, either together or individually, so as to increase the productivity and efficiency of the printing process. Thus, for example, separate varying maintenance intervals can be set for each of the wiping and spitting operations to provide high print quality at maximum efficiency and throughput. Such further embodiments are well within the scope of the present invention.

The following examples are illustrative of embodiments of the present invention, but are not limiting of the invention. It will be apparent, however, that the invention can be practiced with many different types and amounts of materials and can be used for a variety of different uses in accordance with the disclosure above and as pointed out hereinafter.

EXAMPLES

Example 1

Using a preset maintenance interval, various types of images are generated by computer simulation to determine the relative occurrence of leading edge latency defects. Similar print timing and maintenance intervals are used in printing each of the simulated images, so that each image suffers from the same latency effects of the ejected ink drops. In particular, six images are generated, including three shaded images (1/16-tone, 1/4-tone and half-tone), two line art images (thin line and thick line) and one text image.

The leading edge defects of the resulting prints are rated by seven different people by direct visual examination. The prints are rated on a scale of 1 to 4, with 4 indicating good print quality (i.e., very low visually apparent leading edge defects), 3 indicating visually apparent defects but at an acceptable level, 2 indicating visually apparent defects but at a barely acceptable level, and 1 indicating unacceptable print quality. The results are as presented below.

| Image Type | Rating |
|---|---|
| 1/16-tone | 1.6 |
| 1/4-tone | 2.0 |
| half-tone | 2.5 |
| thin line | 2.3 |
| thick line | 2.6 |
| text | 3.0 |

The above tests show that at a set maintenance interval, the degree of leading edge defects varies dependent upon the type of image being printed. By varying the maintenance interval according to the present invention, the degree of leading edge defects can be minimized to provide acceptable print quality throughout the entire range of printing operations.

As will be apparent to one of ordinary skill in the art, numerous changes, alterations and adjustments can be made to the above-described embodiments without departing from the scope of the invention, and the invention is in no way limited to the specific exemplary embodiments described above. One skilled in the art will recognize that the various aspects of the invention discussed above may be selected and adjusted as necessary to achieve specific results for a particular application. Furthermore, although the above discussion has focused upon ink jet printing applications, the invention is in no way limited to ink jet printing, and in act is applicable in other similar type printing operations. Thus, the foregoing embodiments are intended to illustrate and not limit the present invention. It will be apparent that various modifications can be made without departing from the spirit and scope of the invention.

What is claimed is:

1. A method for controlling a maintenance unit in a printer, comprising the steps of:

determining an image type of an image to be printed, said image type being selected from at least a first image type and a second image type different from said first image type, and setting a maintenance interval for said maintenance unit in accordance with said image type, wherein a maintenance interval for said first image type is different from a maintenance interval for said second image type, and wherein said image type is an image object selected from the group consisting of pictorial objects and text objects.

2. The method of claim 1, wherein said image type is selected from the group consisting of graphic images, line drawings, and text images.

3. The method of claim 1, wherein said determining step comprises preprocessing said image to determine said image type prior to printing said image.

4. The method of claim 1, wherein said first image type is a graphic image and said second image type is a text image.

5. The method of claim 1, wherein said determining step comprises accepting a value corresponding to said image type from a separate control mechanism.

6. The method of claim 5, wherein said separate control mechanism is a switch operated by a user of said printer.

7. The method of claim 5, wherein said separate control mechanism is a control code generated by a printer control program.

8. The method of claim 1, wherein said printer is an ink jet printer.

9. The method of claim 1, wherein said maintenance interval corresponds to an interval between successive maintenance operations performed by said maintenance unit on a printhead in said printer.

10. The method of claim 9, wherein said maintenance operations comprise at least one of wiping a front face of said printhead, priming a print nozzle in said printhead, ejecting ink from a nozzle in said printhead, and vacuuming a nozzle in said printhead.

11. The method of claim 1, wherein said maintenance interval is selected from a group of at least two different maintenance intervals.

12. The method of claim 11, wherein said maintenance interval is selected from a group of at least three different maintenance intervals.

13. The method of claim 11, wherein said maintenance interval is selected from a group of at least five different maintenance intervals.

14. The method of claim 1, wherein said maintenance interval is selected to maximize printer throughput while minimizing visible leading edge defects in said image when said image is printed.

15. The method of claim 1, wherein said determining step is performed prior to printing a print job.

16. The method of claim 1, wherein said determining step is performed prior to printing each page of a multi-page print job.

17. The method of claim 1, wherein said determining step is performed prior to printing different image types on a single page.

18. A printer for printing an image on a substrate, comprising:

a printhead, a maintenance unit for performing periodic maintenance on said printhead, and a controller for controlling said maintenance unit according to the method of claim 1.

* * * * *